US009147965B2

(12) United States Patent
Lee

(10) Patent No.: US 9,147,965 B2
(45) Date of Patent: Sep. 29, 2015

(54) MAGNETIC-ENABLED CONNECTOR DEVICE

(71) Applicant: KC MAGCON, INC., Manhattan Beach, CA (US)

(72) Inventor: Vincent Lee, Sante Fe Springs, CA (US)

(73) Assignee: KC MAGCON, INC., Manhattan Beach, CA (US)

( * ) Notice: Subject to any disclaimer, the term of this patent is extended or adjusted under 35 U.S.C. 154(b) by 18 days.

(21) Appl. No.: 14/038,395

(22) Filed: Sep. 26, 2013

(65) Prior Publication Data

US 2014/0087569 A1 Mar. 27, 2014

Related U.S. Application Data

(60) Provisional application No. 61/744,432, filed on Sep. 26, 2012.

(51) Int. Cl.
*H01R 11/30* (2006.01)
*H01R 13/62* (2006.01)
*H01R 13/08* (2006.01)

(52) U.S. Cl.
CPC ..... *H01R 13/6205* (2013.01); *H01R 13/08* (2013.01)

(58) Field of Classification Search
USPC ..... 439/39; 385/57
IPC ..... H01R 13/6205; G02B 6/3886
See application file for complete search history.

(56) References Cited

U.S. PATENT DOCUMENTS

| | | | | |
|---|---|---|---|---|
| 4,874,316 | A * | 10/1989 | Kamon et al. | 439/39 |
| 5,954,520 | A * | 9/1999 | Schmidt | 439/39 |
| 7,329,128 | B1 * | 2/2008 | Awad et al. | 439/38 |
| 2012/0184114 | A1 * | 7/2012 | Li et al. | 439/38 |
| 2014/0162468 | A1 * | 6/2014 | Kim | 439/39 |

FOREIGN PATENT DOCUMENTS

WO WO2012148178 * 11/2012 ..... H01R 13/639

* cited by examiner

*Primary Examiner* — Vanessa Girardi

(57) ABSTRACT

An electrical connector, which may be a multi-pin connector, includes magnetic elements and mechanical alignment elements which provide connective forces and precision alignment and orientation. The magnetic elements permit a user to bring male and female connector portions only into "rough" alignment before magnetic forces bring the portions into the correct position. Pin contacts on the connector portions extend only a small amount beyond respective protective annular openings and are thereby protected. Spring-biased pin elements may be included on one of the connector portions to bias the contact pins into engagement and create conductive paths when the portions are in a connected position. Paramagnetic or non-magnetic sheaths may surround the magnetic elements to focus, or distribute, magnetic forces.

18 Claims, 5 Drawing Sheets

MAGNETIC-ENABLED CONNECTOR DEVICE

CROSS-REFERENCE TO RELATED APPLICATIONS

This application claims the priority benefit of U.S. Provisional Patent Application Ser. No. 61/744,432 titled "MAGNETIC-ENABLED CONNECTOR DEVICE," filed on Sep. 26, 2012, the specification of which is incorporated in its entirety herein by reference.

BACKGROUND

1. Technical Field

The disclosure relates to connectors for electronic devices and data communication. More particularly, the disclosure relates to self-aligning, magnetically biased connectors, including multi-pin connectors.

2. Prior Art

It is generally known to provide magnetic coupling elements in electrical and non-electrical connectors. Examples of connectors that include magnetic coupling elements are disclosed in U.S. Pat. Nos. 4,484,761; 4,776,406; 7,277,013 and 7,334,433. Examples of magnetic breakaway connection devices for power lines or cables are disclosed in U.S. Pat. Nos. 5,315,064 and 5,623,122.

Examples of other types of electrical connectors that include magnetic elements are described in U.S. Pat. Nos. 2,170,287; 3,363,214; 3,431,428; 3,521,216; 3,808,577; 4,844,582; 4,874,316; 5,401,175; 5,812,356; 5,816,825; 5,941,729; 5,954,520; 6,183,264; 6,250,931; 6,267,602; 6,478,614; 6,527,570; 6,561,815; 6,607,391; 6,623,276; 6,727,477; 6,988,897; 7,066,739; 7,264,479; 7,311,526; 7,351,066; 7,517,222; and in U.S. Patent Application Publication Nos. 2004/0209489; 2005/0208783 and 2005/0255718.

U.S. Pat. No. 7,264,479 describes a connector for connecting two coaxial cables, wherein the holding forces between two connector or adapter portions are formed by means of magnetic forces. The mutually facing end faces of the two adapter portions are each provided with disks or plates for grounding. For this reason, connectors of this type require a user to orient and align the two adapter portions axially with respect to one another before the magnetic forces act and peg-shaped contact elements can latch into the corresponding annular mating contact elements.

Multi-pin connectors are useful for connecting signal carriers, such as computer cables, to peripheral devices, such as printers or displays, or for connecting signal carriers or other cables to electronic equipment, such as medical equipment. Multi-pin connectors may incorporate elements for connecting a plurality of conductive paths. Known multi-pin connectors may include connectors known as "D-sub connectors." A D-sub connector contains two or more parallel rows of pins or sockets usually surrounded by a D-shaped metal shield that provides mechanical support, ensures correct orientation, and may screen against electromagnetic interference.

One problem with prior art connectors that utilize threaded fasteners, for example, or which are not readily connected or disconnected, is that in environments where many cables and connectors are utilized, cable management becomes challenging. The rigid coupling implements, i.e., threaded fasteners, of known connectors makes untangling and proper wire or cable routing time consuming. A related problem is that sudden forces on such prior art connectors may cause irreparable damage to the connector, cable or electronic device. For example, in a hospital environment where electronic devices providing vital patient support functions are connected with prior art "hardline" connectors, medical personnel or others tripping over a cable could result in medical equipment falling and being damaged from impact, or other consequences that could be catastrophic to equipment and patients.

Another problem in the prior art is that connectors that utilize multiple pins are prone to damage from misalignment or attempting connection with respective portions in an improper orientation. Typical prior art multi-pin connectors utilize somewhat lengthy pins on the male connector portion, which may extend to a point that is generally flush with the connector shield. Because of their length, the pins are more prone to bending and deformation caused by damage when they are exposed, or by misalignment during the connection process. If connection is attempted before the connector portions are properly aligned, bending, deformation or other damage may result to one or more pin conductors, rendering the connector permanently damaged and useless.

Yet another shortcoming in prior art connectors, such as those that are mechanically connected to a computer, peripheral or other device, for example, using threaded fasteners or other rigid connectors, is that they require dexterity and visibility for connection in hard to reach or confined places, such as in the case where a number of connectors are engaged in the back of a computer or server in a tightly confined space, such as a server rack.

There is thus a need in the art for connectors that address the aforementioned problems in the prior art. The subject matter of the present disclosure is directed to overcoming, or at least reducing the effects of, one or more of the problems set forth above, and others.

SUMMARY OF THE INVENTION

One aspect of the invention provides a multi-pin connector assembly that may be connected more quickly and precisely than prior art connectors and which avoids a "hardline" connection to an electrical or electronic source or target. This aspect is achieved through the use of magnetic elements on respective male and female connector portions, as well as alignment surfaces, which cooperate to allow the user to bring the connector portions only into "rough" alignment before the magnetic forces pull the respective connectors into precise alignment and a complete connection. According to a related aspect of the invention, a connector may be used in confined locations, which would not permit the use of conventional connectors that require tools or manual turning of mechanical screws to complete connections.

Another aspect of the invention ensures proper orientation of the male and female portions of multi-pin connectors. This may be achieved through the use of a pair of magnetic elements on each of the male and female connector portions. The magnetic elements are oriented with opposite polarities, one of each pair having a north pole facing in a forward direction, and the other of each pair having a south pole facing in a forward direction. When the male and female connector portions are brought into proximity in the wrong orientation, the user experiences a tactilely-sensed repulsive force, indicating that the orientation is improper. When the connector portions are brought into proximity with the proper orientation, the attractive magnetic forces complete the connection and, in conjunction with alignment surfaces, bring the connectors and respective multiple pins into perfect alignment. According to another aspect of the invention, an audible "click" may be generated by the impact of respective connector surfaces to indicate to the user that the connector is in a completely connected state.

According to another aspect of the invention, contact pins are provided in a unique configuration which reduces the risk of damage from misalignment or otherwise. Contact pins on the male and female connector elements extend only a small amount beyond respective protective surfaces, such that the pins cannot be damaged from bending or breaking due to lateral forces. A male connector portion includes contact pins that extend only slightly beyond a protective annular opening in the male connector. A female connector portion includes spring-biased connector pins that extend only slightly beyond a protective annular opening in an unconnected state. In a connected state, the male connector pins push spring-biased female connector pins back into the respective annular openings and extend therein, providing further alignment and complete conductive paths.

BRIEF DESCRIPTION OF THE DRAWINGS

The above and other attendant advantages and features of the invention will be apparent from the following detailed description together with the accompanying drawings, in which like reference numerals represent like elements throughout. It will be understood that the description and embodiments are intended as illustrative examples and are not intended to be limiting to the scope of invention, which is set forth in the claims appended hereto.

DETAILED DESCRIPTION

Figure 1:
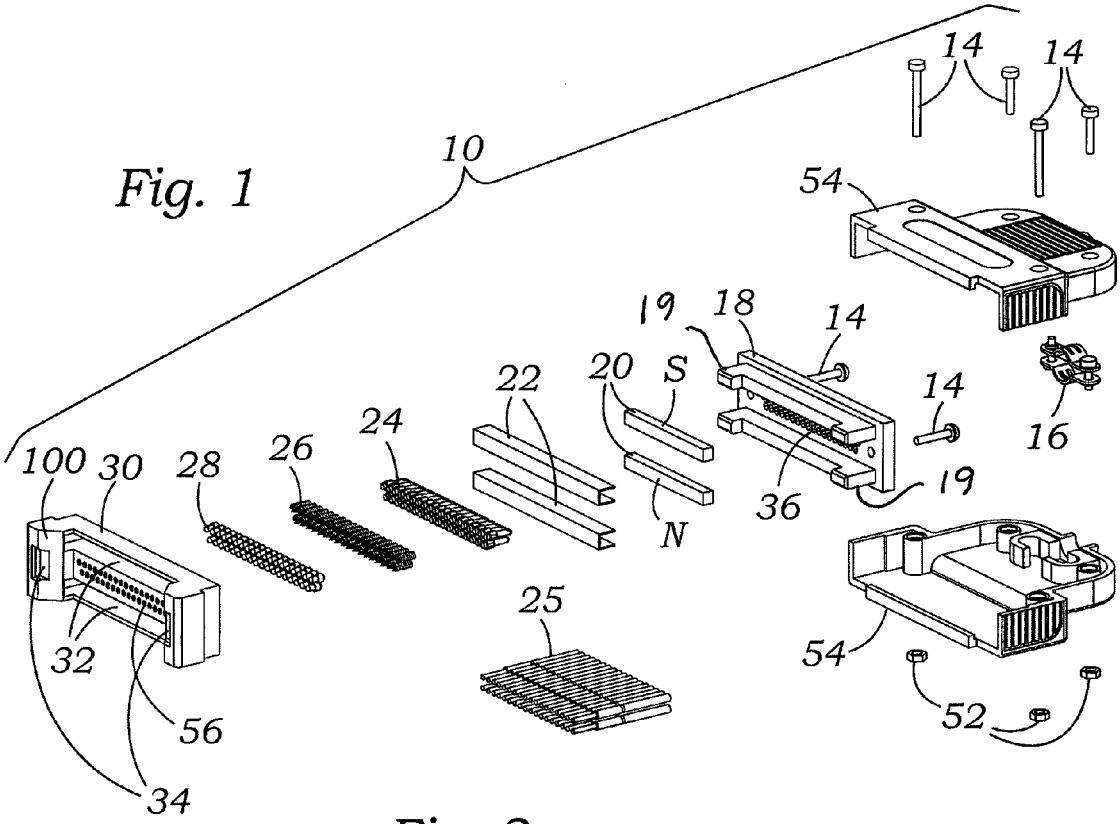
FIG. 1 is an exploded view of a male portion of a connector according to an aspect of the invention.
Figure 6:
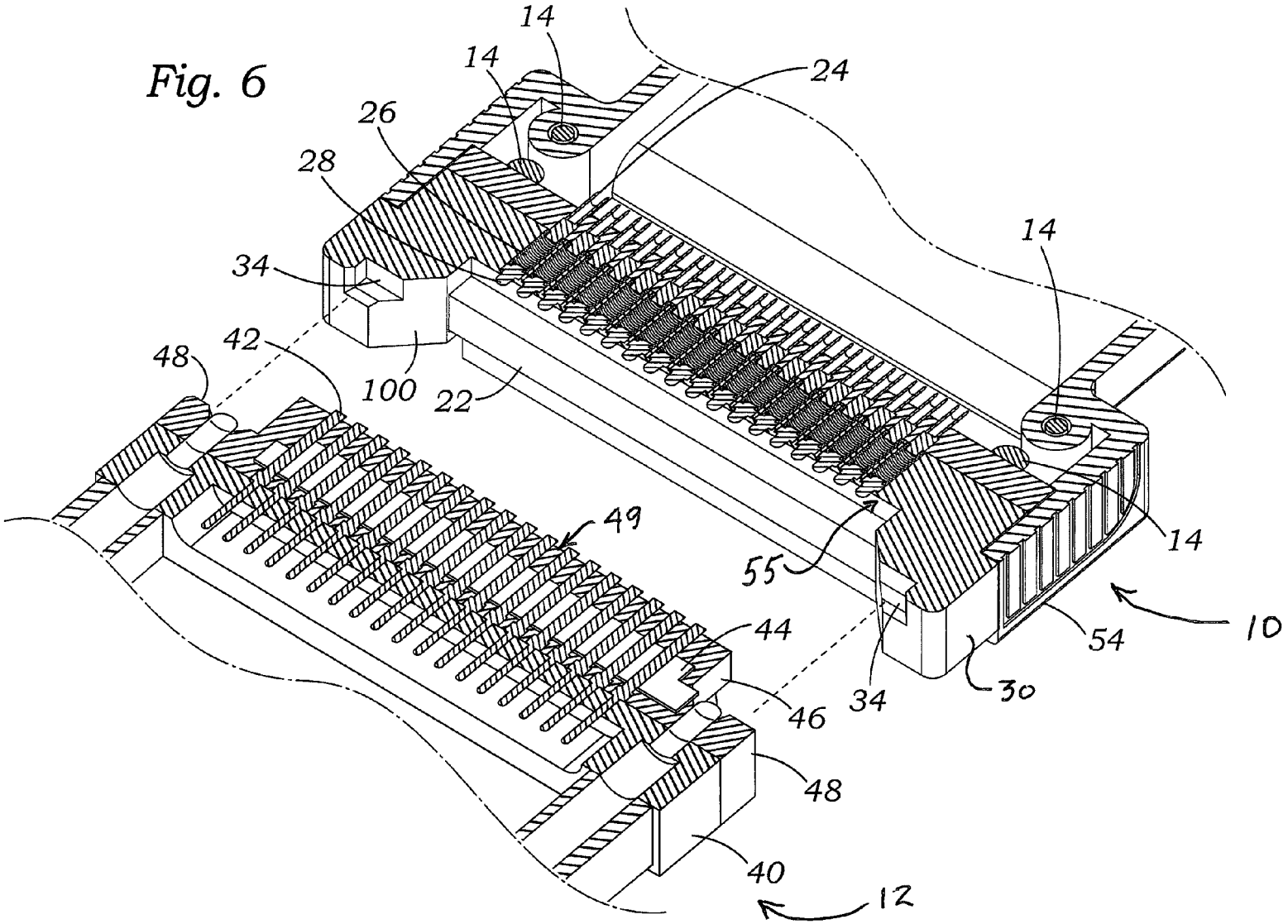
FIG. 6 is a planar, cross-sectional view taken on plane 6-6 in FIG. 5, but showing the male and female connectors in a disconnected position.

FIG. 1 is an exploded view of a female connector 10, according to an aspect of the invention. A plurality of conductive contact pins 28 are disposed within respective annular openings 56 formed in a main seat body 30 of female connector 10. Conductive contact pins 28 may be spring-biased by cooperating with springs 26 and pegs 24, which may be disposed in correspondingly-shaped recesses or cavities 36 formed in an adapter element 18, which cooperates with the main seat body 30 via, for example, threaded fasteners 14, to retain the pins 28, springs 26 and pegs 24 in an assembled position. Pegs 24 may include crimped connectors to receive and secure the ends of respective conductors or wires (not shown) from an electrical source and form a conductive path with springs 24 and pins 28. Referring additionally to FIG. 6, pins 28 may each include a narrow forward portion and a retaining collar or shoulder such that the forward portion is narrow enough to extend into the annular opening 56, while the retaining collar or shoulder prohibits further passage of the pin 28 into the annular opening 56, thereby retaining the pin 28 within the main seat body 30.

According to an aspect of the invention, pins 28, springs 26 and pegs 24 may be replaced with pre-assembled, telescoping spring-biased contact pins 25, which each include a spring element (not shown) disposed within telescoping conductive elements. Contact pins 25 may include any commercially available pre-assemble, telescoping contact pins suitable for use in connector environments.

According to an aspect of the invention, connector 10 may be provided with magnetic elements 20, disposed within complementary-shaped recesses formed in adapter 18, which may be defined between posts or grip legs 19. Sheaths 22 enclose magnets 20 and also partially or wholly enclose the length and depth of grip legs 19 and thereby cooperate with adapter 18, recesses and grip legs 19 to secure the magnets thereon. In accordance with an aspect of the invention, sheaths 22 may be comprised of paramagnetic or non-magnetic material, such as copper, aluminum or bronze, which has the effect of distributing the magnetic field. Also in accordance with an aspect of the invention, sheaths 22 and grip legs 19 may be dimensioned so as to provide some movement of magnets while being retained therein to provide a "floating" mount of the magnets, which enhances the magnetic forces that secure the female connector to a counterpart. Sheaths 22 are received in elongated holes or recesses 36 in seat body 30 and retained therein when the seat body 30 and adapter 18 are in an assembled state.

Housing halves 54 may be provided to enclose the assembled seat body 30 and adapter 18 and may include threaded fasteners 14. A neck grip or tension relief collar 16 secures an electric source or target cable wire (not shown) against slippage within housing 54 and absorbs tension on the cable wire. Alternatively, housing 54 may be formed integrally with seat body 30 and adapter 18 using an injection molding process.

In accordance with an aspect of the invention, seat body 30 is provided with notch recesses 34, which, in a connected state, may receive a complementarily-shaped projection or protuberance, such as protuberances 48 on male connector 12 (FIG. 2), which provides for vertical and lateral alignment of the female connector 10 with a counterpart male connector 12. In accordance with an aspect of the invention, seat body 30 is provided with lateral ramps or inclined surfaces 100, which may be at a 45-degree angle, which provide for lateral alignment of the female connector 10 with a counterpart.

Figure 2:
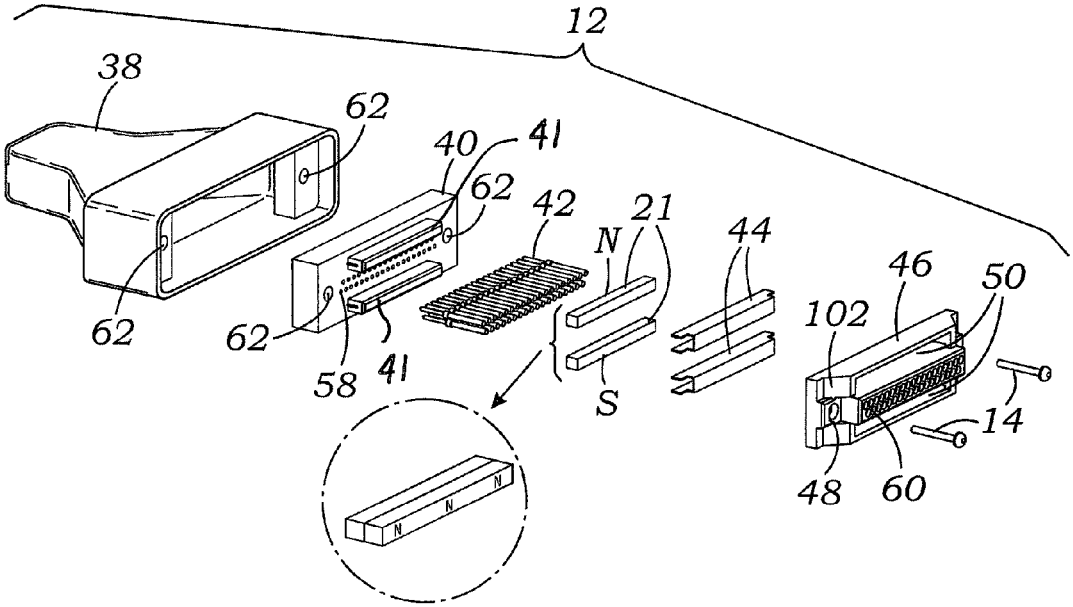
FIG. 2 is an oblique exploded view of a female portion of a connector according to an aspect of the invention.

FIG. 2 shows an exploded view of a male connector 12 in accordance with an aspect of the invention. The male connector 12 may include a male contact plate 46 and a male foundation plate 40, which cooperate to retain male connector magnets 21 and male conductive pins 42 therein. Male contact plate 46 includes a plurality of pinholes or annuluses 60 formed therein to receive a like plurality of male conductive pins 42 in an array, such as parallel rows. The back ends of the male pins 42 may be seated in concavities 58 in foundation plate 40. The male pins 42 extend in a forward direction through the annuluses 60 to thereby provide a conductive path from foundation plate 40 thru contact plate 46. Foundation plate 40 includes protuberances or raised portions 41 for supporting magnets 21 thereon. Male sheaths 44, which may partially or completely cover or enclose magnets and secure magnets 21 against protuberances 41, are also received in elongate openings 50 of male contact plate 46 and retained therein, also retaining magnets within the male connector 12 in an assembled state. As shown in the zoomed-in view in FIG. 2, male magnets 21 may be oriented such that a top magnet has a north polarity facing forward, toward a male connector counterpart (not shown in FIG. 2), whereas a lower magnet has a south polarity facing forward, toward the male connector counterpart. Threaded fasteners 14 may secure the male contact plate 46 to the foundation plate 40 and may also secure the assembled contact plate 46 and foundation plate 40 to a male housing 38 via threaded holes 62.

Figure 3:
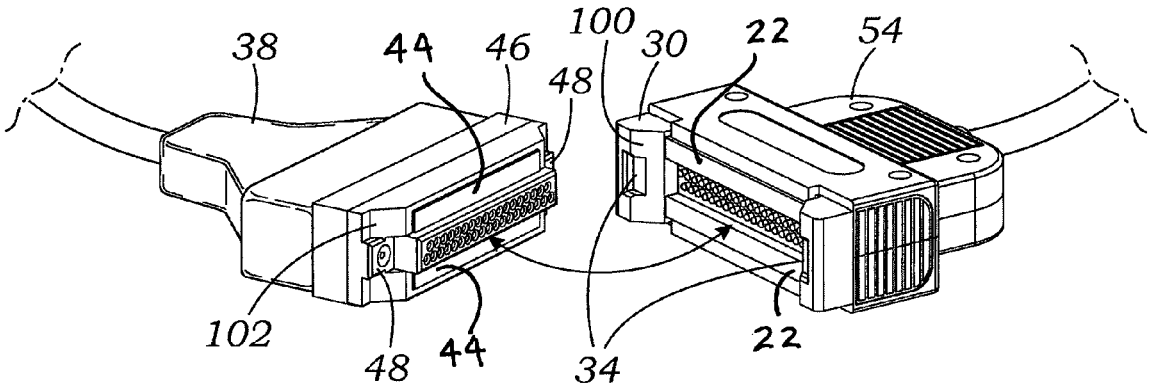
FIG. 3 is an oblique view showing male and female connector portions in a disconnected position.
Figure 4:
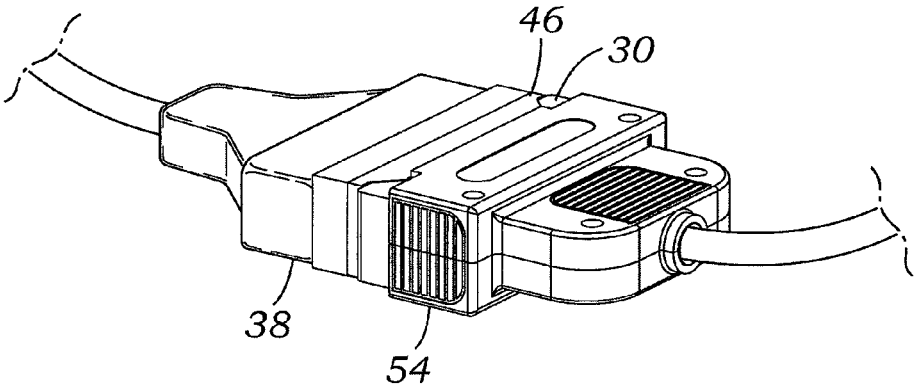
FIG. 4 is an oblique view showing male and female connector portions in a connected position.

Referring additionally to FIG. 3, according to an aspect of the invention, contact plate 46 is provided with ramped or angled surfaces 102, which cooperate with the ramps 100 (FIG. 1) on female connector body 30, to provide for easy connection and positive alignment of the male connector 12 and female connector 10. Protuberances 48 are also received within recesses 34 to provide for positive vertical and lateral alignment. Magnetic biasing forces are provided via female connector magnets 21 (situated behind sheath 44 in FIG. 3) and male connector magnets (situated behind sheath 22 in FIG. 3) such that the male and female connectors are magnetically attracted to one another. As will be appreciated by those of ordinary skill in the art, owing to the alignment elements, including protuberances 48, recesses 34, ramps 100 and surfaces 102, as the male and female connector portions are roughly aligned by a user and put in close proximity to one another, the magnetic forces further pull the respective connectors into perfect alignment and together, without a user having to precisely align them, to a completely connected state shown in FIGS. 4 and 5. More specifically, the physical structure of male ramps 102 and female ramps 100 prevents the male connector 12 and female connector 10 from skipping one or more magnetic peaks and valleys to the right or to the left, prior to connecting, and thus prevents male pins 42 from misalignment or improper connection with female pins 28. The cooperating ramp surfaces 100 and 102 sets up left to right, or lateral, physical centering, for approximate guidance at a gap distance, as well as precision guidance to final plug-in and contact as the connectors move to close proximity. The ramps set up a funneling effect to channel the connectors towards each other in the correct position.

According to an aspect of the invention, vertical, or top to bottom centering, as well as proper orientation, is facilitated by the female magnets 20 and male magnets 21, as well as the female notches 34 and protuberances 48. With regard to orientation, the reverse polarities of the top and bottom male and female magnets results in repulsive forces if the male connector is improperly oriented, i.e., rotated 180-degrees from a proper orientation. Thus, tactile sensing of repulsive forces may indicate to a user that orientation is improper without the user having to view the actual the orientation of the connector. In this way, the user is prevented from connecting the connectors in an improper orientation. As a result, potential damage to the connector, or more catastrophic consequences, such as failure or misalignment of an electronic connector in a medical environment, is prevented. Also, in accordance with an aspect of the invention, the contact of forward surfaces of respective sheaths 44 and 42 may cause an audible signal, such as a "click," to indicate to the user that the connector is completely connected and aligned.

Figure 5:
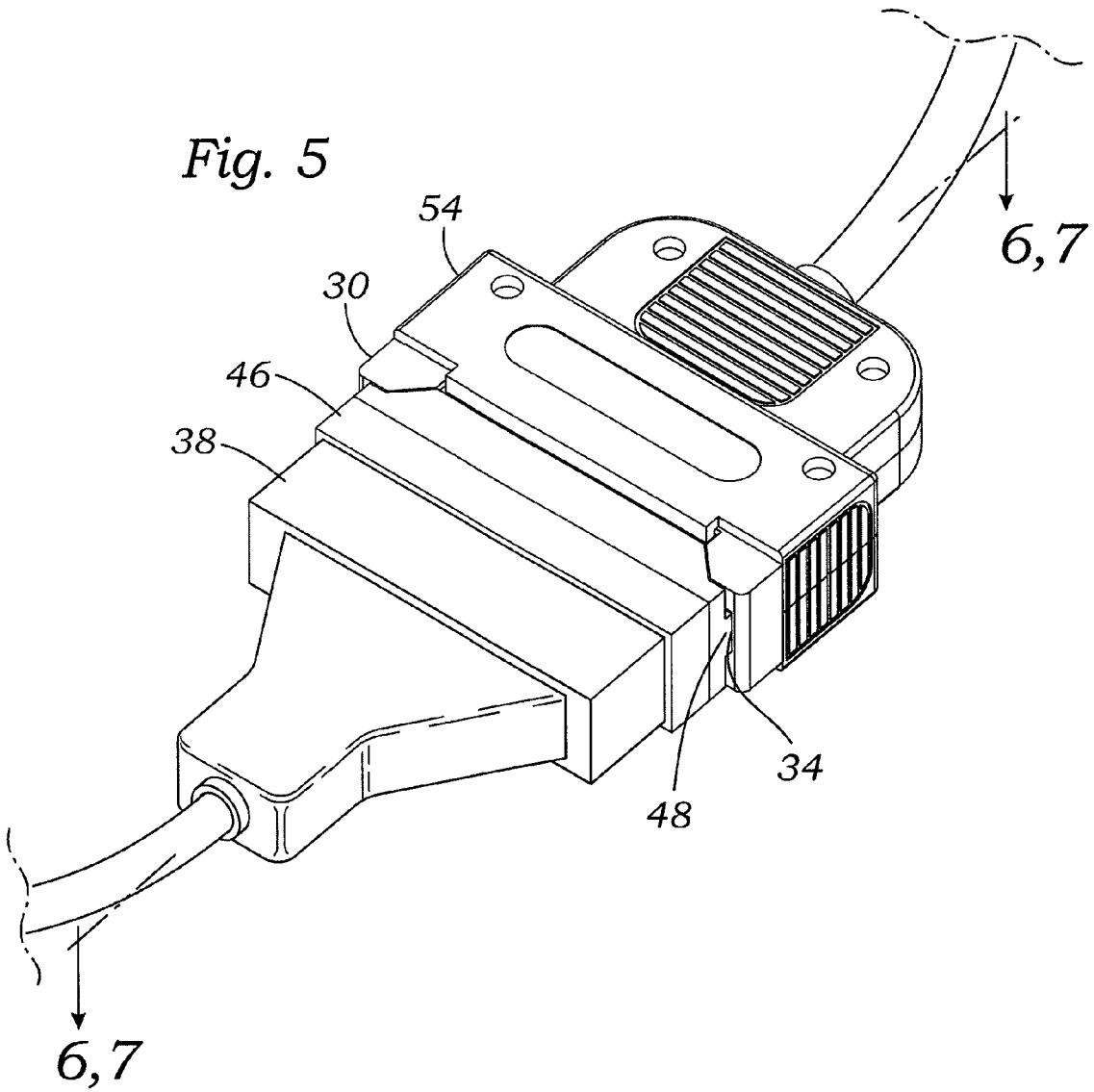
FIG. 5 is an enlarged, oblique view showing male and female connector portions in a connected position.

FIG. 6 is a planar cross-sectional view taken along lines 6-6 in FIG. 5, showing the male 12 and female 10 connectors in a disconnected configuration. It can be seen that, in the disconnected configuration, the contact pins 28 of female connector 10 extend beyond a front surface 55 of the female seat body 30. Contact pins 28 are biased in this direction by springs 26. Contact pins 42 on male connector 12 also extend beyond a front surface 49 of the male contact plate 46. Thus, contact between pins 42 and pins 28 is ensured as the male and female connector portions move to a connected state. Moreover, it will be noted that the contact pins 42 do not extend significantly beyond the male contact plate, thus preventing deformation (i.e., lateral bending) or damage to the pins when exposed in the disconnected state.

Figure 7:
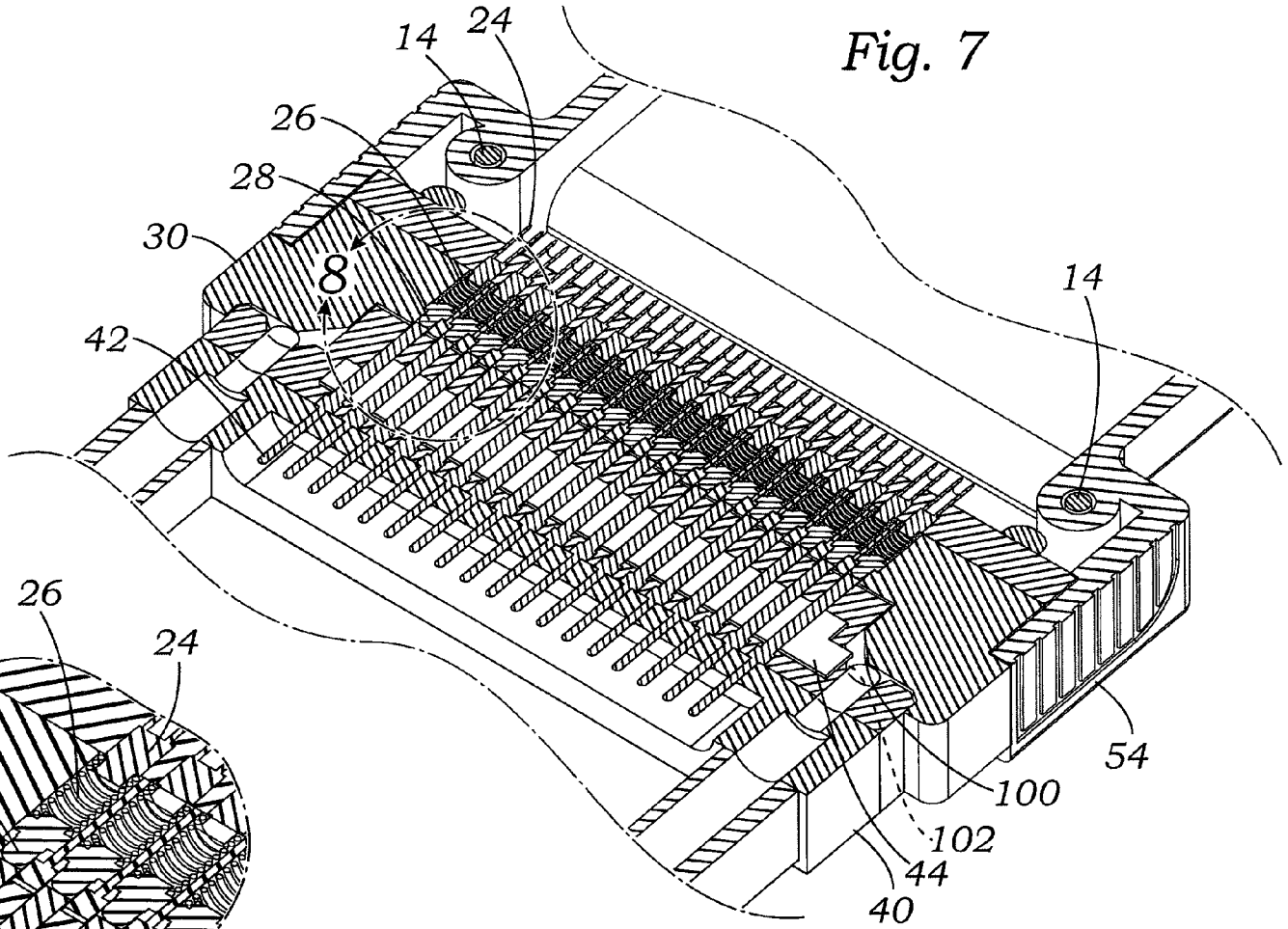
FIG. 7 is a planar, cross-sectional view taken on plane 7-7 in FIG. 5, showing the male and female connectors in a connected position.
Figure 8:
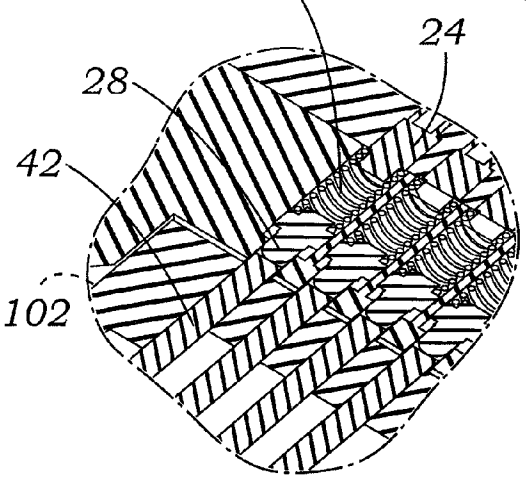
FIG. 8 is an enlarged view of area "8" in FIG. 7.

FIG. 7 is a planar cross-sectional view taken along lines 7-7 in FIG. 5 showing the male 12 and female 10 connectors in a connected configuration. In this configuration, male connector 12 and female connector 10 are held together by magnetic forces and, as may be seen in the enlarged view in FIG. 8, female connector contact pins 28 are pushed back into annular openings 60 by male contact pins 42, against the biasing force of springs 26. Forward ends of male contact pins 42 may thus extend to some degree into the annular openings 60 on the female seat body 30. Thus, each contact pin 28 is biased into contact with a respective contact pin 42 to make sufficient electrical contact and to allow for variances in pin length or wear that may occur.

It should be understood that implementation of other variations and modifications of the invention in its various aspects may be readily apparent to those of ordinary skill in the art, and that the invention is not limited by the specific embodiments described herein. It is therefore contemplated to cover, by the present invention any and all modifications, variations or equivalents that fall within the spirit and scope of the claims that follow.

What is claimed is:

1. A connector assembly comprising:

a female connector including:

a seat body having a plurality of seat body annular openings formed therein;

a plurality of first conductive pins disposed within respective ones of the seat body annular openings, the conductive pins being biased in a forward direction by biasing elements;

at least one female connector magnet disposed within a recess formed in the seat body; and at least one female connector alignment surface formed in the seat body; and a male connector including:

a contact frame, including a plurality of contact frame annular openings formed therein;

a plurality of second conductive pins disposed within respective ones of the contact frame annular openings; the conductive pins extending beyond a forward surface of the contact frame and adapted to engage respective ones of the first conductive pins and extend into the seat body annular openings;

at least one male connector magnet disposed within a recess formed in the contact frame, the male connector magnet cooperating with the female connector magnet to secure the male connector and the female connector in a connected position;

at least one male connector alignment surface formed on the seat body for cooperating with the at least one female connector alignment surface to align the male connector with the female connector when moved into a connected position; and at least one sheath for at least partially enclosing one of the at least one male connector magnet or at least one female connector magnet.

2. The connector assembly of claim 1, wherein the at least one sheath is comprised of a non-magnetic material.

3. The connector assembly of claim 1, wherein the at least one sheath is comprised of a paramagnetic material.

4. The connector assembly of claim 1, wherein the female connector alignment surface comprises a pair of opposed ramp surfaces.

5. The connector assembly of claim 1, wherein the biasing elements comprise a spring and peg associated with each of the conductive pins, the pegs being secured in recesses formed in an adapter of the female connector.

6. The connector assembly of claim 1, wherein each of first conductive pins comprise pre-assembled, telescoping pins.

7. The connector assembly of claim 1, wherein the at least one male connector magnet includes a pair of magnets, each mounted on an opposite side of the male connector, and wherein the at least one female connector magnet includes a pair of magnets, each mounted on an opposite side of the female connector, the respective male and female connector magnets being of opposite polarity such that attractive forces are present when the male connector is properly oriented relative to the female connector, and repulsive forces are present when the male connector is improperly oriented relative to the female connector.

8. A connector comprising:

a contact frame, including a plurality of contact frame annular openings formed therein;

a plurality of conductive pins disposed within respective ones of the contact frame annular openings; the conductive pins extending beyond a forward surface of the contact frame and adapted to engage respective ones of corresponding conductive pins on a counterpart connector;

a pair of connector magnets disposed within respective recesses formed in the contact frame;

a pair of sheaths, each at least partially enclosing a respective one of the connector magnets and distributing magnetic forces thereof;

a pair of alignment ramps formed on the seat body for cooperating with corresponding surfaces on the counterpart connector; and a pair of alignment recesses formed on the seat body for receiving alignment projections formed on the counterpart connector.

9. The connector of claim 8, wherein each one of the pair of connector magnets is oriented with a polarity opposite the other.

10. The connector of claim 8, wherein the conductive pins comprise pre-assembled, telescoping, spring-biased pins.

11. The connector of claim 8, wherein the sheaths comprise a non-magnetic material.

12. The connector of claim 8, wherein the sheaths comprise a paramagnetic material.

13. A connector assembly comprising:

a female connector including:

a seat body having a plurality of seat body annular openings formed therein;

a plurality of first conductive pins disposed within respective ones of the seat body annular openings, the conductive pins being biased in a forward direction by biasing elements;

at least one female connector magnet disposed within a recess formed in the seat body; and at least one female connector alignment surface formed in the seat body; and a male connector including:

a contact frame, including a plurality of contact frame annular openings formed therein;

a plurality of second conductive pins disposed within respective ones of the contact frame annular openings; the conductive pins extending beyond a forward surface of the contact frame and adapted to engage respective ones of the first conductive pins and extend into the seat body annular openings;

at least one male connector magnet disposed within a recess formed in the contact frame, the male connector magnet cooperating with the female connector magnet to secure the male connector and the female connector in a connected position;

at least one male connector alignment surface formed on the seat body for cooperating with the at least one female connector alignment surface to align the male connector with the female connector when moved into a connected position;

wherein the biasing elements comprise a spring and peg associated with each of the conductive pins, the pegs being secured in recesses formed in an adapter of the female connector.

14. The connector assembly of claim 13, wherein the at least one sheath is comprised of a non-magnetic material.

15. The connector assembly of claim 13, wherein the at least one sheath is comprised of a paramagnetic material.

16. The connector assembly of claim 13, wherein the female connector alignment surface comprises a pair of opposed ramp surfaces.

17. The connector assembly of claim 13, wherein each of first conductive pins comprise pre-assembled, telescoping pins.

18. The connector assembly of claim 13, wherein the at least one male connector magnet includes a pair of magnets, each mounted on an opposite side of the male connector, and wherein the at least one female connector magnet includes a pair of magnets, each mounted on an opposite side of the female connector, the respective male and female connector magnets being of opposite polarity such that attractive forces are present when the male connector is properly oriented relative to the female connector, and repulsive forces are present when the male connector is improperly oriented relative to the female connector.

* * * * *